US005336578A

United States Patent [19]

Nukada et al.

[11] Patent Number: 5,336,578

[45] Date of Patent: Aug. 9, 1994

[54] PHTHALOCYANINE MIXED CRYSTAL AND ELECTROPHOTOGRAPHIC PHOTORECEPTOR CONTAINING THE SAME

[75] Inventors: Katsumi Nukada; Akira Imai; Katsumi Damion; Masakazu Iijima, all of Minami-Ashigara, Japan

[73] Assignee: Fuji Xerox Co., Ltd., Tokyo, Japan

[21] Appl. No.: 2,251

[22] Filed: Jan. 8, 1993

[30] Foreign Application Priority Data

Jan. 13, 1992 [JP] Japan ..... 4-021681

[51] Int. Cl.[5] ..... G03G 5/06

[52] U.S. Cl. ..... 430/78; 540/141

[58] Field of Search ..... 430/58, 59, 78, 135

[56] References Cited

U.S. PATENT DOCUMENTS 5,087,540 2/1992 Murakami et al. ..... 430/58
5,227,271 7/1993 Kikuchi et al. ..... 430/59

FOREIGN PATENT DOCUMENTS 54-44684 12/1979 Japan .
55-27583 7/1980 Japan .
62-67094 3/1987 Japan .
62-119547 5/1987 Japan .
1-142658 6/1989 Japan .
1-144057 6/1989 Japan .
1-221459 9/1989 Japan .
2-70763 3/1990 Japan .
2-170166 6/1990 Japan .
2-272067 11/1990 Japan .
3-9962 1/1991 Japan .
3-116630 5/1991 Japan .
3-126489 5/1991 Japan .
2-274872 12/1991 Japan .

*Primary Examiner*—John Goodrow
*Attorney, Agent, or Firm*—Oliff & Berridge

[57] ABSTRACT

A novel phthalocyanine mixed crystal comprising a dihalogenotin phthalocyanine and a halogenogallium phthalocyanine and an electrophotographic photoreceptor containing the same are disclosed. The phthalocyanine mixed crystal preferably has an intense X-ray diffraction peak at a Bragg angle ($2\theta \pm 0.2°$) of 26.9. The phthalocyanine mixed crystal is useful as a charge generating material which provides an electrophotographic photoreceptor excellent in sensitivity, stability on repeated use, and environmental stability.

12 Claims, 15 Drawing Sheets

PHTHALOCYANINE MIXED CRYSTAL AND ELECTROPHOTOGRAPHIC PHOTORECEPTOR CONTAINING THE SAME

FIELD OF THE INVENTION

This invention relates to a mixed crystal of a dihalogenotin phthalocyanine and a halogenogallium phthalocyanine and an electrophotographic photoreceptor containing the same.

BACKGROUND OF THE INVENTION

Known charge generating materials having sensitivity in the near infrared region which can be used in electrophotographic photoreceptors include squarylium pigments, bisazo pigments, trisazo pigments, and phthalocyanine pigments. Of these materials, phthalocyanine pigments have recently been attracting particular attention because of their high sensitivity, and various species thereof having different crystal forms have hitherto been proposed for use as a charge generating material of electrophotographic photoreceptors. For example, JP-A-1-221459 (the term "JP-A" as used herein means an "unexamined published Japanese patent application") describes that gallium phthalocyanine species showing intense X-ray diffraction peaks at Bragg angles ($2\theta\pm0.2°$) of 6.7°, 15.2°, 20.5°, and 27.0°; at Bragg angles of 6.7°, 13.7°, 16.3°, 20.9°, and 26.3°; or at Bragg angles of 7.5°, 9.5°, 11.0°, 13.5°, 19.1°, 20.3°, 21.8°, 25.8°, 27.1°, and 33.0°; or having an intense peak at a Bragg angle of 27.1° with the intensities of the other peaks being not more than 10% of that peak are effective as a charge generating material. Further, a novel dichlorotin phthalocyanine crystal and its combination with a charge transporting material are disclosed, e.g., in JP-A-1-144057 and JP-A-62-119547.

JP-A-62-67094 discloses oxytitanium phthalocyanine having the most intense diffraction peak at a Bragg angle ($2\theta\pm0.2°$) of 27.3°. Although this particular oxytitanium phthalocyanine has very high sensitivity, it has poor stability on repeated use, poor crystal form stability in a coating composition, and insufficient dispersibility. In order to settle these problems, it has been proposed to incorporate a small amount of substituted phthalocyanine as described, e.g., in JP-A-3-9962, JP-B-55-27583, and JP-B-54-44684 (the term "JP-B" as used herein means an "examined Japanese patent publication"). In this case, however, since substituted phthalocyanine incorporated is markedly different from unsubstituted phthalocyanine in crystal form, mixing them gives rise to another problem, such as reduction in electrophotographic characteristics.

On the other hand, various mixed crystals comprising oxytitanium phthalocyanine and other phthalocyanine species are known as disclosed, e.g., in JP-A-1-142658, JP-A-2-70763, JP-A-2-170166 and JP-A-2-272067.

The inventors have studied various phthalocyanine crystal forms in pursuit of an electrophotographic photoreceptor with excellent electrophotographic characteristics and productivity and found, as a result, a novel crystal form of a halogenogallium phthalocyanine having high sensitivity as disclosed in Japanese Patent Application No. Hei-3-116630. They also found various novel crystal forms of a dihalogenotin phthalocyanine as disclosed in Japanese Patent Application Nos. Hei-3-126489 and Hei-3-274872. It turned out, however, that the halogenogallium phthalocyanine is slightly inferior to the dihalogenotin phthalocyanine in stability to environmental changes and that the dihalogenotin phthalocyanine is, though very excellent in stability to environmental changes, slightly inferior to the halogenogallium phthalocyanine in sensitivity.

SUMMARY OF THE INVENTION

An object of the present invention is to provide a mixed crystal comprising a dihalogenotin phthalocyanine and a halogenogallium phthalocyanine which is suitable for producing an electrophotographic photoreceptor having excellent stability on repeated use and excellent environmental stability.

Another object of the present invention is to provide an electrophotographic photoreceptor excellent in stability on repeated use and stability to environmental changes.

The inventors have conducted extensive investigations on crystal forms of various phthalocyanine complexes. As a result, they found that a novel mixed crystal comprising a dihalogenotin phthalocyanine and a halogenogallium phthalocyanine is an excellent charge generating material for electrophotographic photoreceptors. The present invention has been completed based on this finding.

The present invention relates to a phthalocyanine mixed crystal comprising a dihalogenotin phthalocyanine and a halogenogallium phthalocyanine.

The present invention also relates to an electrophotographic photoreceptor having a photosensitive layer containing a phthalocyanine mixed crystal comprising a dihalogenotin phthalocyanine and a halogenogallium phthalocyanine as a charge generating material.

BRIEF DESCRIPTION OF THE ACCOMPANYING DRAWINGS

FIGS. 3 through 22 each is a powder X-ray diffraction pattern of a phthalocyanine mixed crystal obtained in Examples 1 to 20, respectively.

Figure 23:
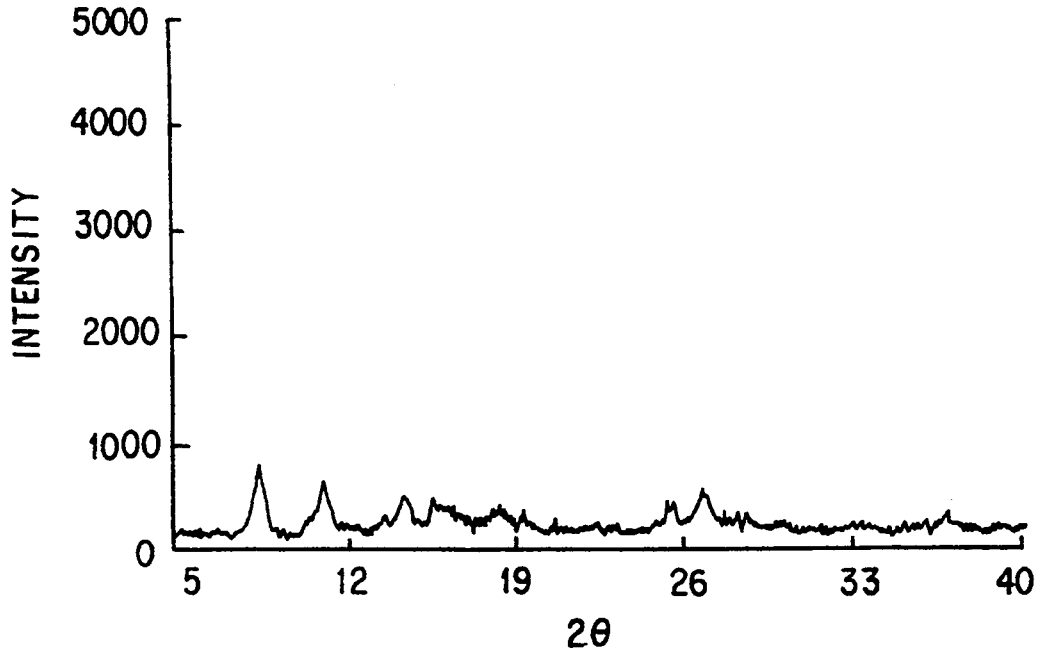

FIG. 23 is a powder X-ray diffraction pattern of a dichlorotin phthalocyanine crystal obtained in Comparative Example 1.

Figure 24:
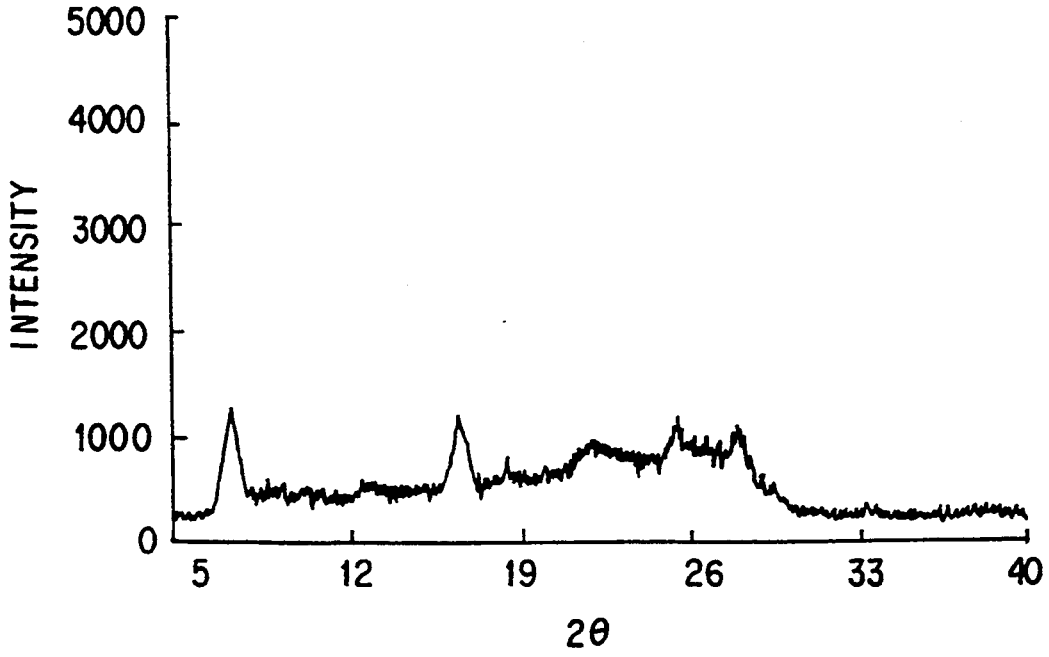

FIG. 24 is a powder X-ray diffraction pattern of a chlorogallium phthalocyanine crystal obtained in Comparative Example 2.

Figure 25:
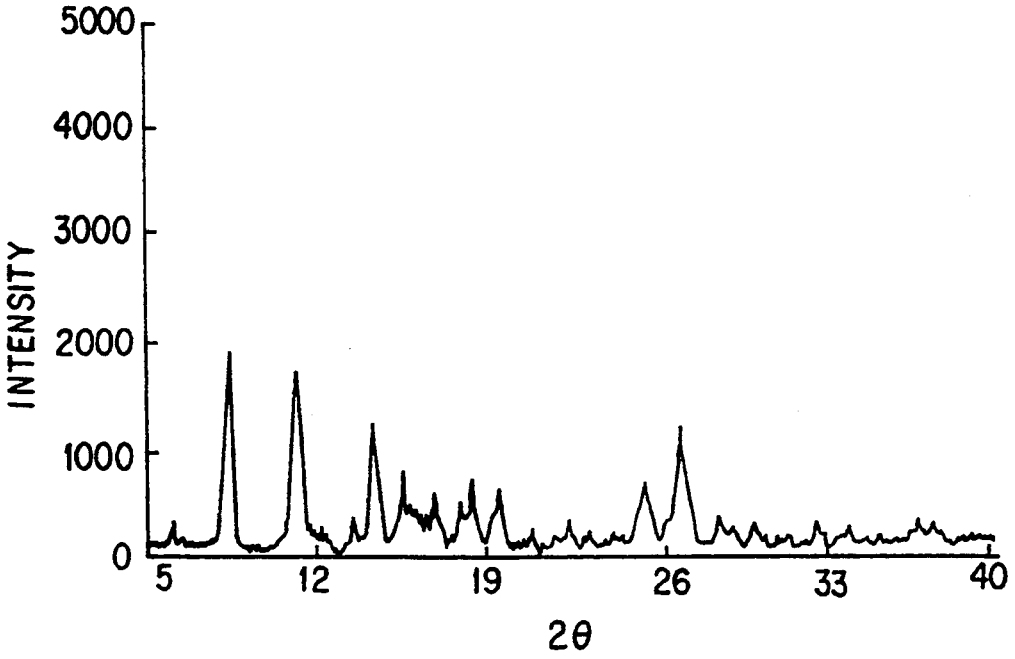
Figure 26:
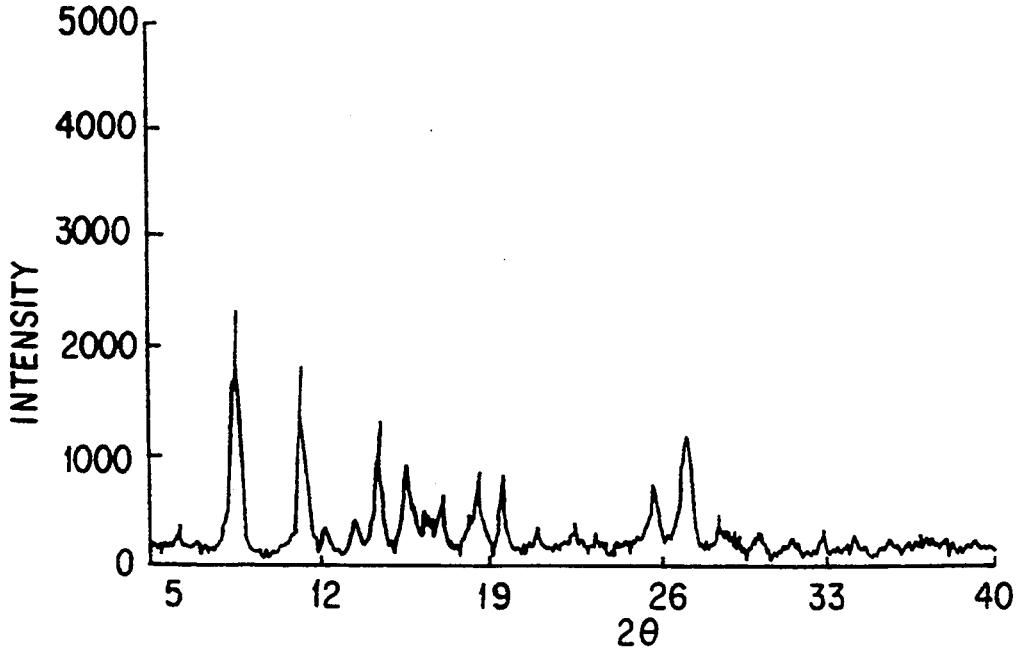
Figure 27:
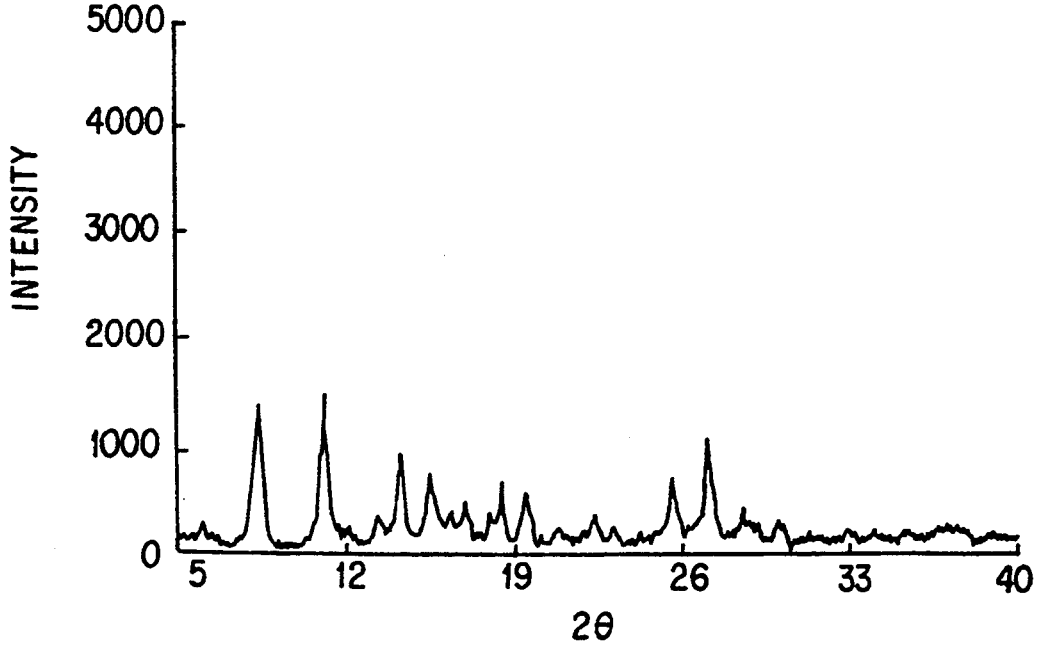

FIGS. 25 to 27 each is a powder X-ray diffraction pattern of a dichlorotin phthalocyanine crystal obtained in Comparative Examples 3 to 5, respectively.

Figure 28:
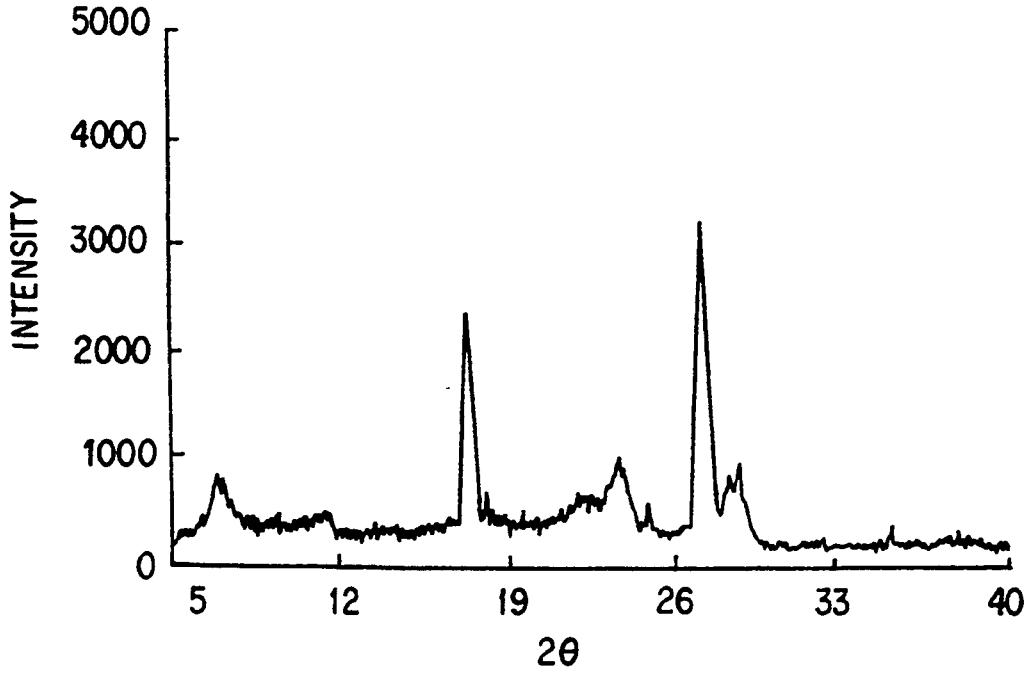
Figure 29:
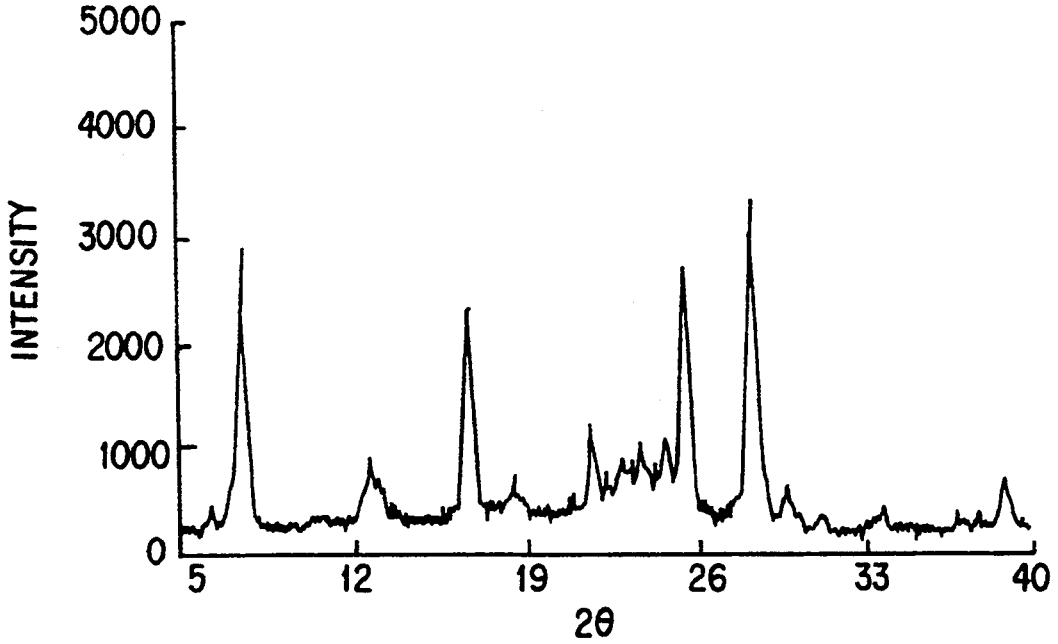
Figure 30:
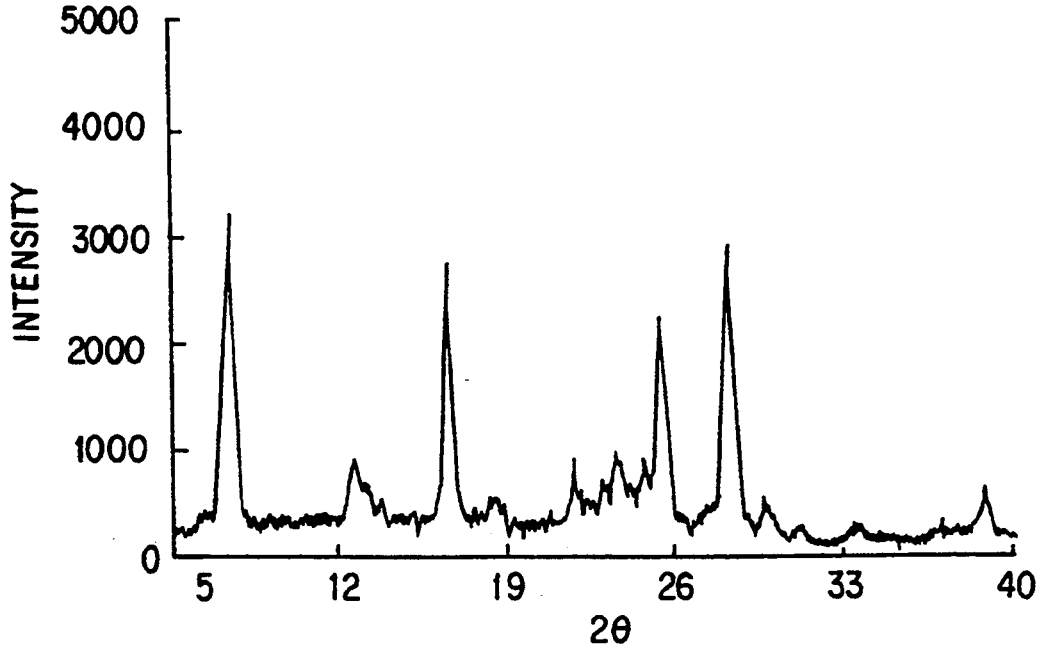

FIGS. 28 to 30 each is a powder X-ray diffraction pattern of a chlorogallium phthalocyanine crystal obtained in Comparative Examples 6 to 8, respectively.

DETAILED DESCRIPTION OF THE INVENTION

The mixed crystal comprising a dihalogenotin phthalocyanine and a halogenogallium phthalocyanine according to the present invention preferably includes those having an intense X-ray diffraction peak at a Bragg angle ($2\theta\pm0.2°$) of 26.9° because of their very high sensitivity.

In the present invention, the X-ray diffraction pattern is the measurement results of intensities of the Bragg angle ($2\theta$) with respect to $CuK_\alpha$ characteristic X-ray (wavelength: 1.541 Å. The measurement conditions are as follows:

Apparatus: X-ray diffractometer ("RAD-RC" produced by Rigaku K.K.)
Target: Cu (1.54050 Å)
Voltage: 40.0 KV
Current: 30 mA
Start angle: 5.00 deg
Stop angle: 40.00 deg
Step angle: 0.020 deg The ionization potential (Ip) of a halogenogallium phthalocyanine is from about 5.2 to 5.3 eV while that of a dihalogenotin phthalocyanine is from about 5.4 to 5.5 eV. The difference in ionization potential between the two crystals constituting the mixed crystal seems to contribute to sensitizing effects.

The dihalogenotin phthalocyanine which can be used in the present invention is represented by formula:

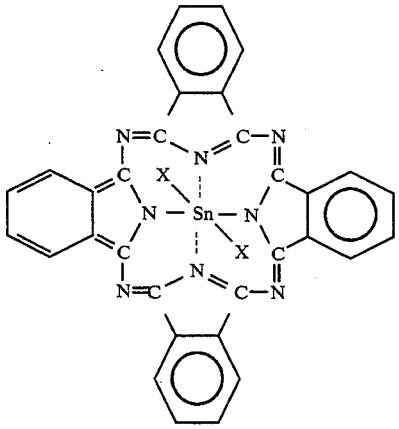

wherein X represents a fluorine atom, a chlorine atom, a bromine atom, or an iodine atom. A hydrogen atom on the benzene ring of the dihalogenotin phthalocyanine may be substituted with a halogen atom, though an unsubstituted dihalogenotin phthalocyanine is preferable.

The dihalogenotin phthalocyanine can be synthesized by known processes, such as a process comprising reacting phthalonitrile or diiminoisoindoline with tin dichloride or tin tetrachloride in an appropriate organic solvent (e.g., aromatic hydrocarbons such as toluene, xylene or chlorobenzene and ethers such as tetrahydrofuran or 1,4-dioxane). The dihalogenotin phthalocyanine preferably includes dichlorotin phthalocyanine.

The halogenogallium phthalocyanine which can be used in the present invention is represented by formula:

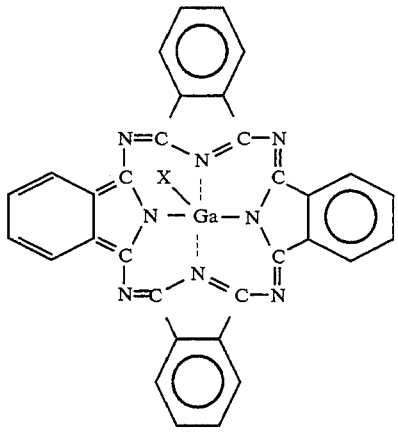

wherein X is as defined above. A hydrogen atom on the benzene ring of the halogenogallium phthalocyanine may be substituted with a halogen atom, though an unsubstituted halogenogallium phthalocyanine is preferable.

The halogenogallium phthalocyanine can be synthesized by known processes, such as a process comprising reacting a trihalogenogallium and phthalonitrile or diiminoisoindoline in an appropriate organic solvent (e.g., reaction-inactive solvents having a high boiling point such as $\alpha$-chloronaphthalene, $\beta$-chloronaphthalene, $\alpha$-methylnaphthalene, methoxynaphthalene, diphenylethane, ethyleneglycol, dialkylether, quinoline, sulfone, dichlorobenzene, and dichlorotoluene). The halogenogallium phthalocyanine preferably includes chlorogallium phthalocyanine.

In the preparation of the phthalocyanine mixed crystal of the present invention, the dihalogenotin phthalocyanine and the halogenogallium phthalocyanine are mixed at an appropriate ratio. The mixing ratio of dihalogenotin phthalocyanine/halogenogallium phthalocyanine is preferably from 5/95 to 50/50 by weight. The mixture thereof is ground by dry grinding or milling (e.g., salt milling) in a ball mill, a sand mill, a kneader, a mortar, etc. for 2 to 72 hours, preferably for 5 to 48 hours to the particle size of 0.15 $\mu$m or less so that the X-ray diffraction spectrum of the ground mixture reveals no clear peak. In salt milling, a water-soluble inorganic salt such as sodium chloride and salt cake is preferably used and the amount of salt used is from 0.5 to 20 times, preferably from 1 to 10 times based on the pigment. Alternatively, each of the starting phthalocyanine compounds is separately made non-crystalline and then mixed together. Then, the resulting non-crystalline mixture is treated with an organic solvent. Examples of useful organic solvents include halogenated hydrocarbons, e.g., methylene chloride and chloroform; aromatic hydrocarbons, e.g., toluene, benzene, and chlorobenzene; alcohols, e.g., methanol and ethanol; ketones, e.g., acetone and methyl ethyl ketone; acetic esters, e.g., ethyl acetate and butyl acetate; aliphatic hydrocarbons, e.g., hexane and octane; ethers e.g., diethyl ether, dioxane, and tetrahydrofuran (THF); and mixtures of these organic solvents, or mixtures of these organic solvents and water. Of these, methylene chloride is particularly preferred. The amount of the organic solvent is enough if a pigment can be contacted with the solvent, but is preferably 5 to 30 times based on the pigment from the standpoint of homogeneous stirring and effective post-treatment (removal the solvent).

It is effective that the above-described operation for obtaining a non-crystalline mixture is preceded by a treatment of the starting phthalocyanine compounds with a solvent, such as dimethylformamide, N-methylpyrrolidone, THF, methylene chloride, or sulfolane, to render the phthalocyanine compounds compatible with each other for 2 to 48 hours, preferably for 5 to 24 hours. The amount of the solvent to be used and the solvent treating time are not particularly limited. The solvent treating time is preferably 5 to 168 hours, more preferably 10 to 48 hours. It is also effective that the solvent treatment of the mixture is conducted while milling in a ball mill, a sand mill, etc.

The phthalocyanine mixed crystal of the present invention exhibits stability of crystal form, dispersibility, and sensitivity when used as a charge generating material of a photosensitive layer of an electrophotographic photoreceptor and therefore provides an electrophotographic photoreceptor excellent in stability on repeated use and environmental stability.

The electrophotographic photoreceptor according to the present invention comprises a conductive substrate having provided thereon a photosensitive layer containing the above-mentioned phthalocyanine mixed crystal. The photosensitive layer may have a single layer structure or a laminate structure composed of a charge generating layer and a charge transporting layer.

Where a photosensitive layer has a laminate structure, the charge generating layer comprises the phthalocyanine mixed crystal of the present invention and a binder resin. The binder resin to be used is selected from a wide range of insulating resins or organic photoconductive polymers, e.g., poly-N-vinyl carbazole, polyvinyl anthracene, polyvinyl pyrene, and polysilane. Examples of suitable binder resins are insulating resins, such as polyvinyl butyral resins, polyarylate resins (e.g., a polycondensate of bisphenol A and phthalic acid), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol, and polyvinyl pyrrolidone. These binder resins may be used either individually or in combination of two or more thereof.

The charge generating layer is formed by coating on a conductive substrate a coating composition prepared by dispersing the phthalocyanine mixed crystal of the present invention in a solution of the binder resin in an organic solvent. A compounding ratio of the phthalocyanine mixed crystal to the binder resin preferably ranges from 10:1 to 1:10 by weight. While dispersion may be effected by any usual dispersing methods, for example, by means of a ball mill, an attritor, a sand mill, etc., it is required to select conditions which do not cause any change of crystal form. The inventors have ascertained that any of the above-mentioned dispersing methods brings about no change in crystal form.

It is effective to finely disperse the mixture to a particle size of not more than 0.5 μm, preferably not more than 0.3 μm, and more preferably not more than 0.15 μm.

Examples of suitable organic solvents to be used include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, THF, chloroform, and methylene chloride. These organic solvents may be used either individually or in combination of two or more thereof.

The coating composition for a charge generating layer can be coated by any of known coating techniques, such as blade coating, wire bar coating, spray coating, dip coating, bead coating, air knife coating, and curtain coating. The charge generating layer usually has a thickness of from 0.1 to 5 μm, and preferably from 0.2 to 2.0 μm.

The charge transporting layer of the laminate structure comprises a charge transporting material and a binder resin. Any of known charge transporting materials including amino compounds, hydrazone compounds, pyrazoline compounds, oxazole compounds, oxadiazole compounds, stilbene compounds, carbazole compounds, and benzidine compounds, may be employed. These charge transporting materials may be used either individually or in combination of two or more thereof.

The binder resins which can be used in the charge transporting layer include polycarbonate resins, polyester resins, methacrylic resins, acrylic resins, a polyvinyl chloride resin, a polyvinylidene chloride resin, a polystyrene resin, a polyvinyl acetate resin, a styrene-butadiene copolymer, a vinylidene chloride-acrylonitrile copolymer, a vinyl chloride-vinyl acetate copolymer, a vinyl chloride-vinyl acetate-maleic anhydride copolymer, silicone resins, silicone-alkyd resins, phenol-formaldehyde resins, styrene-alkyd resins, and poly-N-vinylcarbazole. These binder resins may be used either individually or in combination of two or more thereof.

The charge transporting layer can be formed by coating a substrate with a coating composition comprising the above described charge transporting material, a binder resin, and an organic solvent. The solvent to be used include benzene, ketones (e.g., 2-butanone), halogenated aliphatic hydrocarbons, e.g., methylene chloride, chloroform, and ethylene chloride, and cyclic or straight chain ethers, e.g., THF and ethyl ether. These solvents may be used either individually or in combination of two or more thereof. A compounding ratio of the charge transporting material to the binder resin preferably ranges from 10:1 to 1:5 by weight.

The coating composition for a charge transporting layer can be coated by any of known coating techniques, such as blade coating, wire bar coating, spray coating, dip coating, bead coating, air knife coating, and curtain coating. The charge transporting layer usually has a thickness of from about 5 to 50 μm, and preferably from 10 to 30 μm.

Where a photoreceptor has a single layer structure, the photosensitive layer is a photoconductive layer comprising a binder resin having dispersed therein a charge transporting material and the phthalocyanine mixed crystal according to the present invention. The charge transporting material and binder resin to be used are the same as those described above. Formation of the photoconductive layer can be effected in the same manner as described above.

For the purpose of preventing the photoreceptor from deterioration on contact with ozone or an oxidative gas generated in the copying machine or on exposure to light or heat, additives, such as antioxidants, light stabilizers, and heat stabilizers, may be incorporated into the photosensitive layer.

Examples of suitable antioxidants include hindered phenol, hindered amine, p-phenylenediamine, arylalkanes, hydroquinone, spirocoumarone, spiroindanone, or derivatives thereof; organic sulfur compounds, and organic phosphorus compounds.

Examples of suitable light stabilizers are benzophenone, benzotriazole, dithiocarbamates, and tetramethylpiperidine.

Further, in order to improve sensitivity, to reduce a residual potential, or to reduce fatigue on repeated use, the photosensitive layer may contain at least one electron-accepting substance. Examples of suitable electron-accepting substances include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Preferred of them are fluorenone compounds, quinone compounds, and benzene derivatives having an electron-attracting substituent, e.g., Cl, CN, or $NO_2$.

If desired, a protective layer may be provided on the charge generating layer of the laminate type photosensitive layer. The protective layer serves to prevent chemical changes of the charge transporting layer on charging and also to improve mechanical strength of the photosensitive layer.

The protective layer can be formed by coating a conductive material dispersed in an appropriate binder resin. Examples of suitable conductive materials include metallocene compounds, e.g., N,N'-dimethylferrocene, aromatic amine compounds, e.g., N,N'-diphenyl-N,N'-bis(3-methylphenyl)-[1,1'biphenyl]-4,4'-diamine, and metallic compounds, e.g., antimony oxide, tin oxide, titanium oxide, indium oxide, tin oxide-antimony oxide. However, the invention is not limited to the above-mentioned compounds. Examples of suitable binder resins include polyamide resins, polyurethane resins, polyester resins, epoxy resins, polyketone resins, polycarbonate resins, polyvinyl ketone resins, polystyrene resins, and polyacrylamide resins.

The protective layer is preferably constructed so as to have an electrical resistivity of from $10^9$ to $10^{14}$ Ω·cm. If the resistivity exceeds $10^{14}$ Ω·cm, the residual potential would increase only to provide copies suffering from fog. If it is lower than $10^9$ Ω·cm, image blur or reduction in resolving power would result.

Further, the protective layer, if provided, should be so designed as not to interfere with transmission of light for imagewise exposure.

The protective layer usually has a thickness of from 0.5 to 20 μm, and preferably from 1 to 10 μm.

Coating of the protective layer may be carried out by any known coating techniques, such as blade coating, wire bar coating, spray coating, dip coating, bead coating, air knife coating, and curtain coating.

The present invention is now illustrated by way of Synthesis Examples, Examples, and Comparative Examples, but it should be understood that the present invention is not deemed to be limited thereto. All the percents and parts are given by weight unless otherwise indicated.

SYNTHESIS EXAMPLE 1

Figure 1:
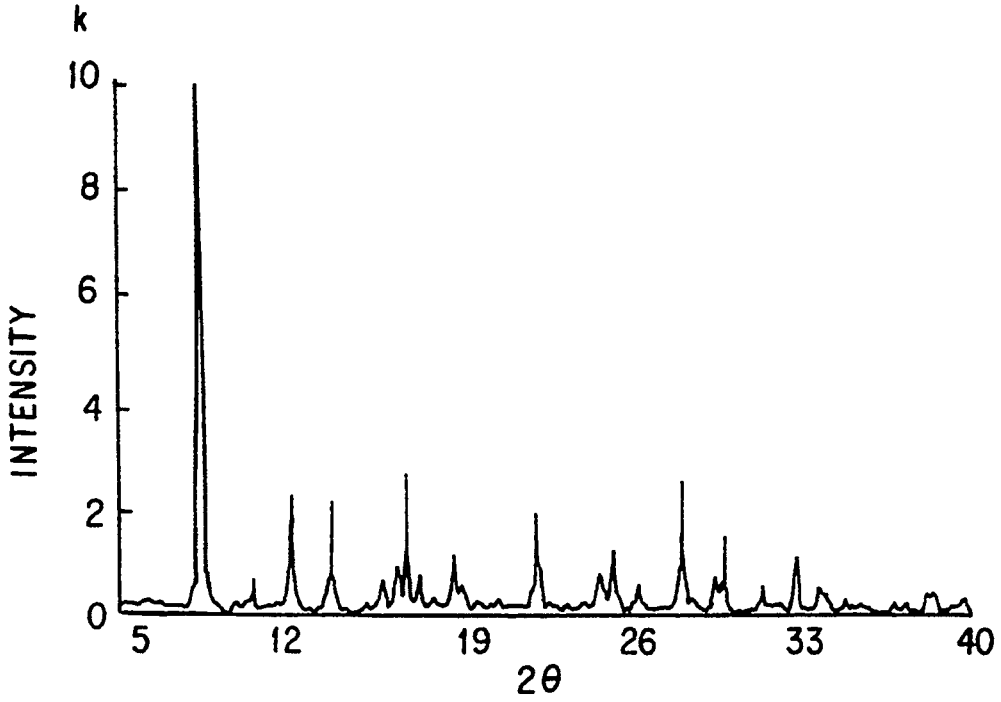
FIG. 1 is a powder X-ray diffraction pattern of the dichlorotin phthalocyanine crystal obtained in Synthetic Example 1.

To 350 ml of 1-chloronaphthalene were added 50 g of phthalonitrile and 27 g of anhydrous stannic chloride, and the mixture was allowed to react at 195° C. for 5 hours. The reaction product was collected by filtration, washed successively with 1-chloronaphthalene, acetone, methanol, and water, and dried under reduced pressure to obtain 18.3 g of a dichlorotin phthalocyanine crystal. The powder X-ray diffraction pattern of the resulting dichlorotin phthalocyanine crystal is shown in FIG. 1 wherein the intense X-ray diffraction peaks are at Bragg angles ($2\theta \pm 0.2°$) of 8.5°, 12.2°, 16.9°, and 28.2°.

SYNTHESIS EXAMPLE 2

Figure 2:
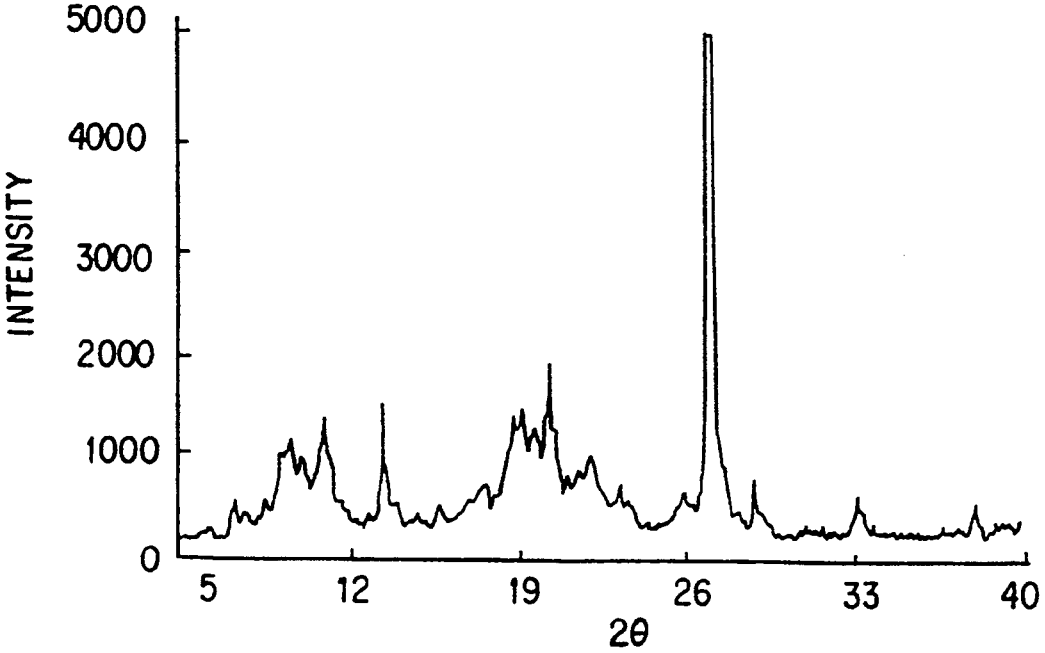
FIG. 2 is a powder X-ray diffraction pattern of the chlorogallium phthalocyanine crystal obtained in Synthetic Example 2.

Thirty grams of 1,3-diiminoisoindoline and 9.1 g of gallium trichloride were added to 230 g of quinoline, and the mixture was allowed to react at 200° C. for 3 hours in a nitrogen stream. The reaction product was collected by filtration, washed successively with acetone and methanol, and dried to obtain 28 g of a chlorogallium phthalocyanine crystal. The powder X-ray diffraction pattern of the resulting chlorogallium phthalocyanine crystal is shown in FIG. 2 wherein the intense X-ray diffraction peaks are at Bragg angles ($2\theta \pm 0.2°$) of 13.4°, 20.3°, and 27.1°.

EXAMPLE 1

Figure 3:
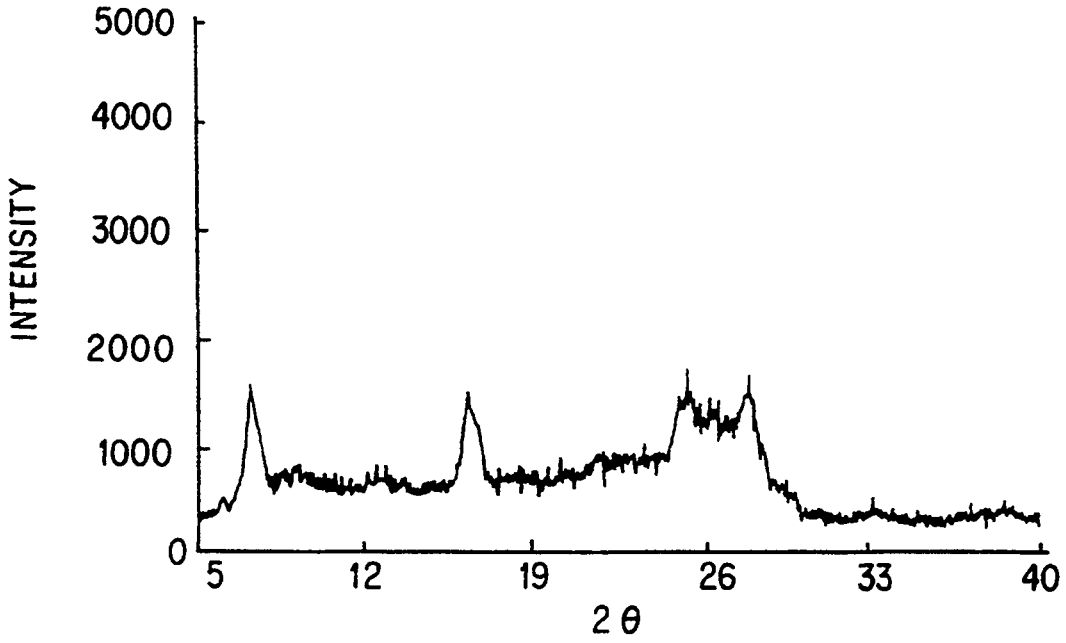
Figure 4:
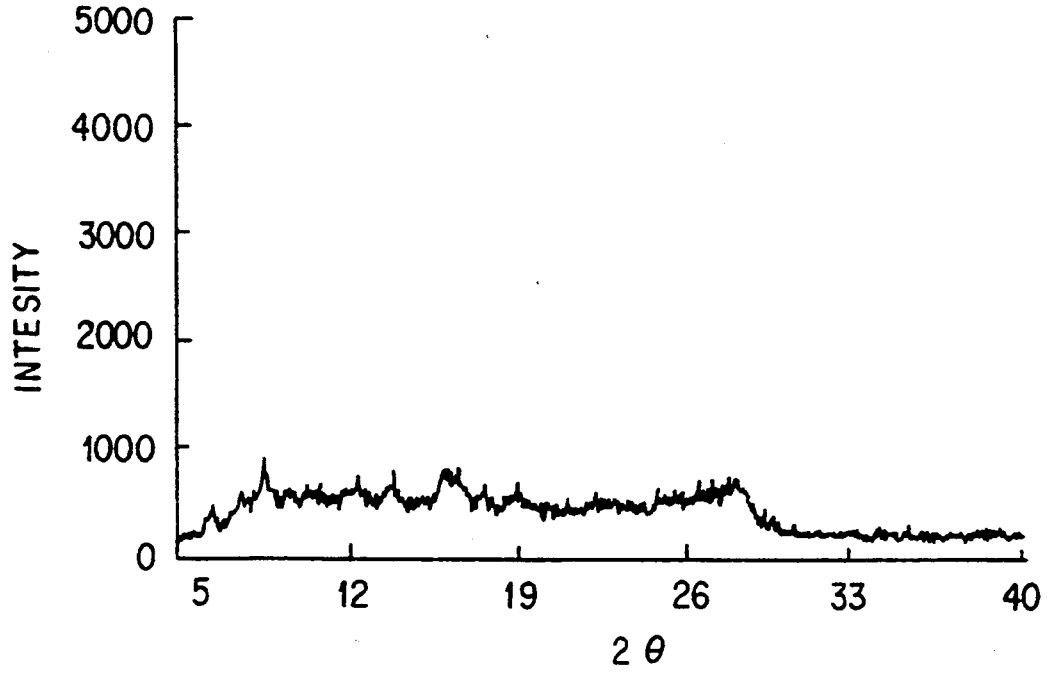
Figure 5:
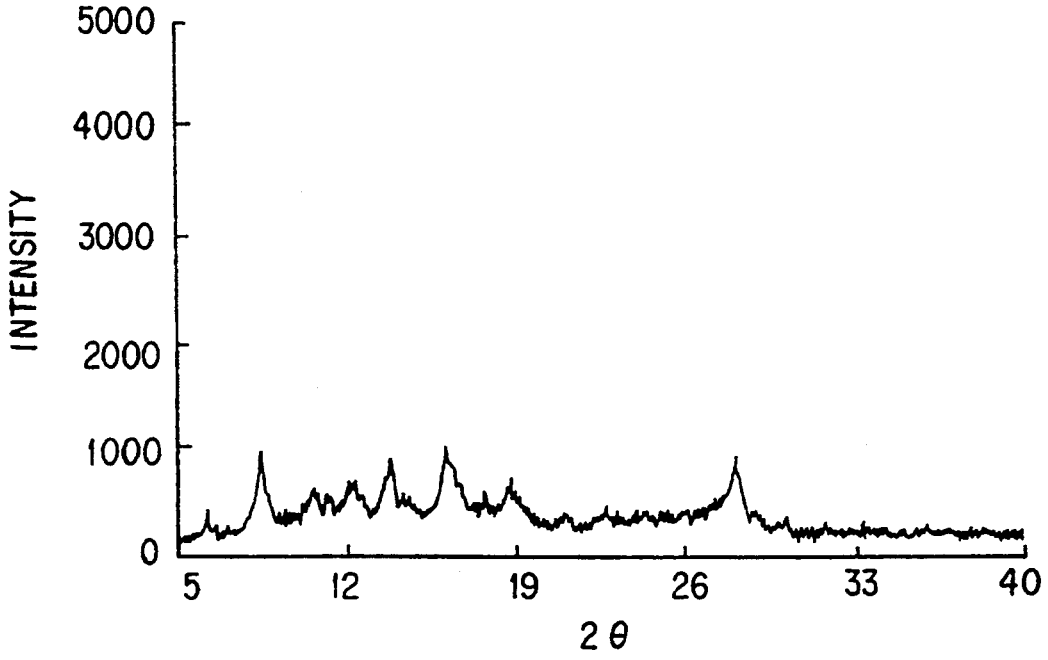
Figure 6:
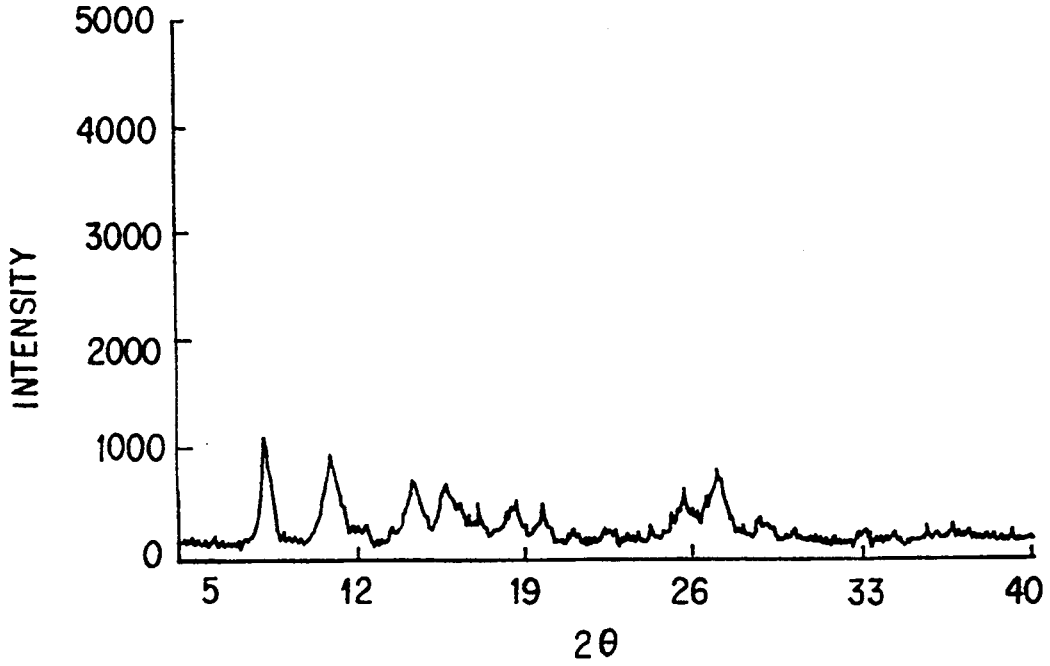
Figure 7:
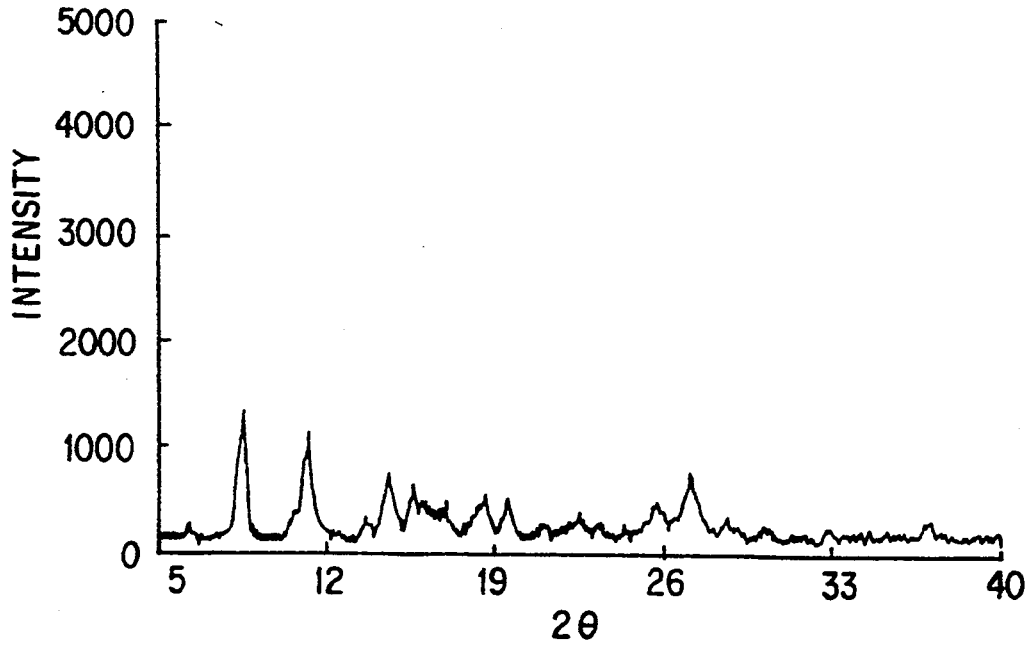

The dichlorotin phthalocyanine crystal (0.5 g) obtained in Synthesis Example 1 and 9.5 g of the chlorogallium phthalocyanine crystal obtained in Synthesis Example 2 were put in an agate mortar together with 50 g of agate balls (diameter: 20 mm) and ground in a planetary ball mill ("P-5" manufactured by Fritch) at 400 rpm for 24 hours. The powder X-ray diffraction pattern of the resulting powder is shown in FIG. 3.

EXAMPLES 2 to 5

A phthalocyanine mixed crystal was prepared in the same manner as in Example 1, except for changing the dichlorotin phthalocyanine to chlorogallium phthalocyanine ratio as shown in Table 1 below. The powder X-ray diffraction pattern of each mixed crystal is shown in FIGS. 4 to 7.

EXAMPLE 6

Figure 8:
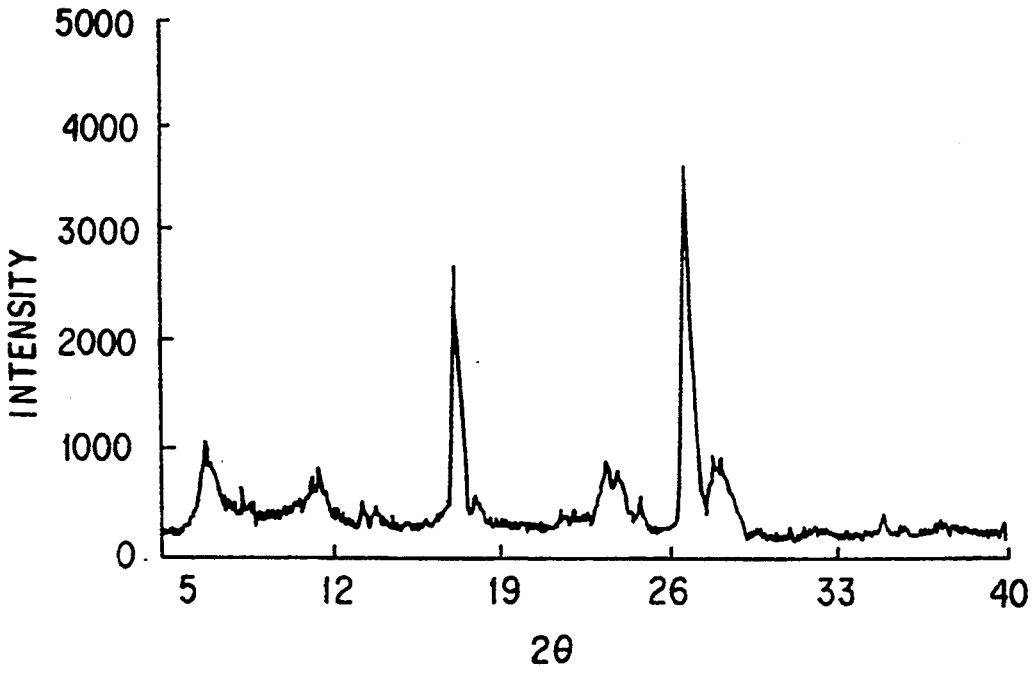
Figure 9:
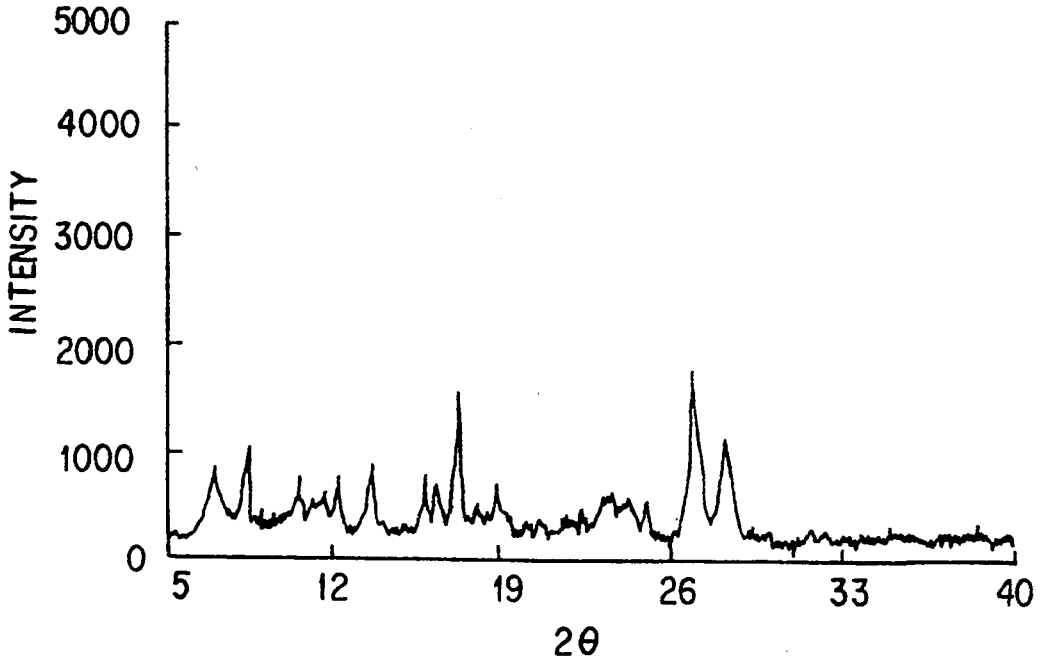
Figure 10:
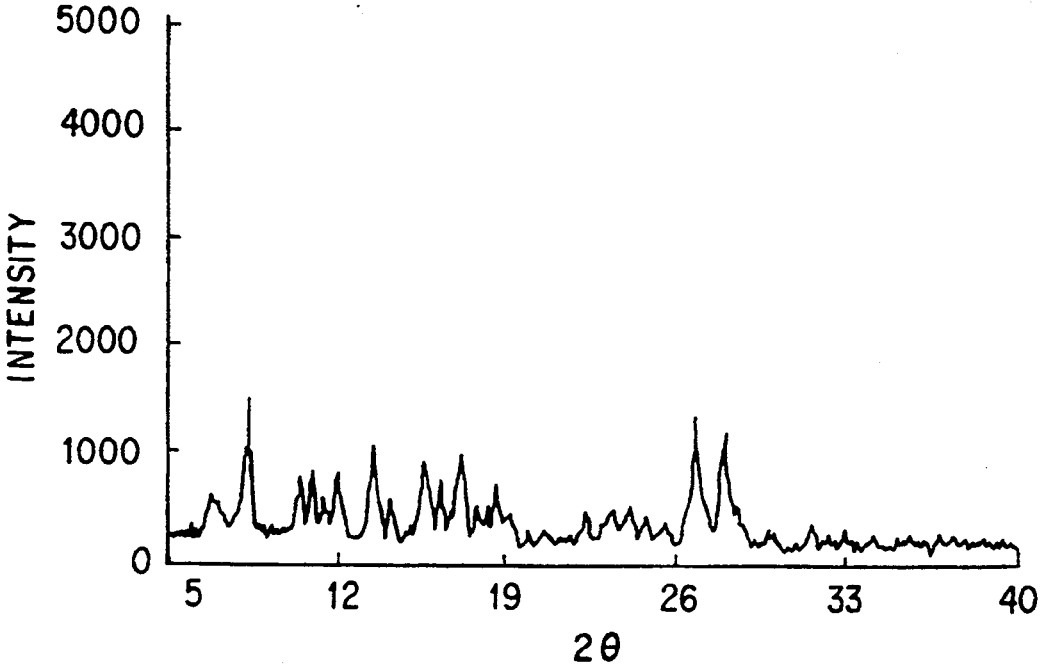
Figure 11:
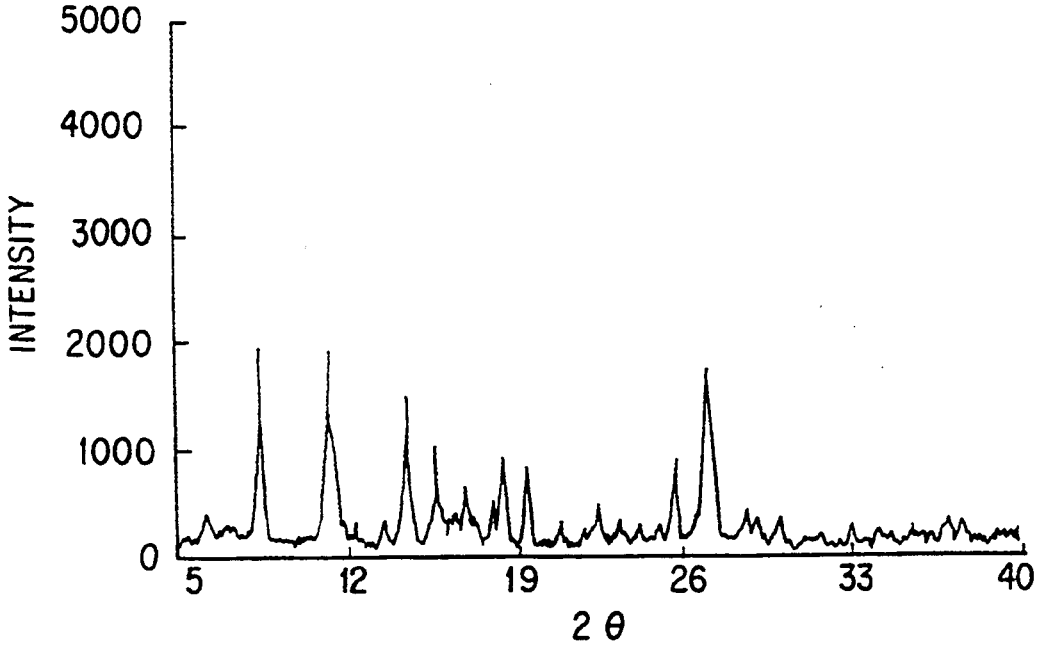
Figure 12:
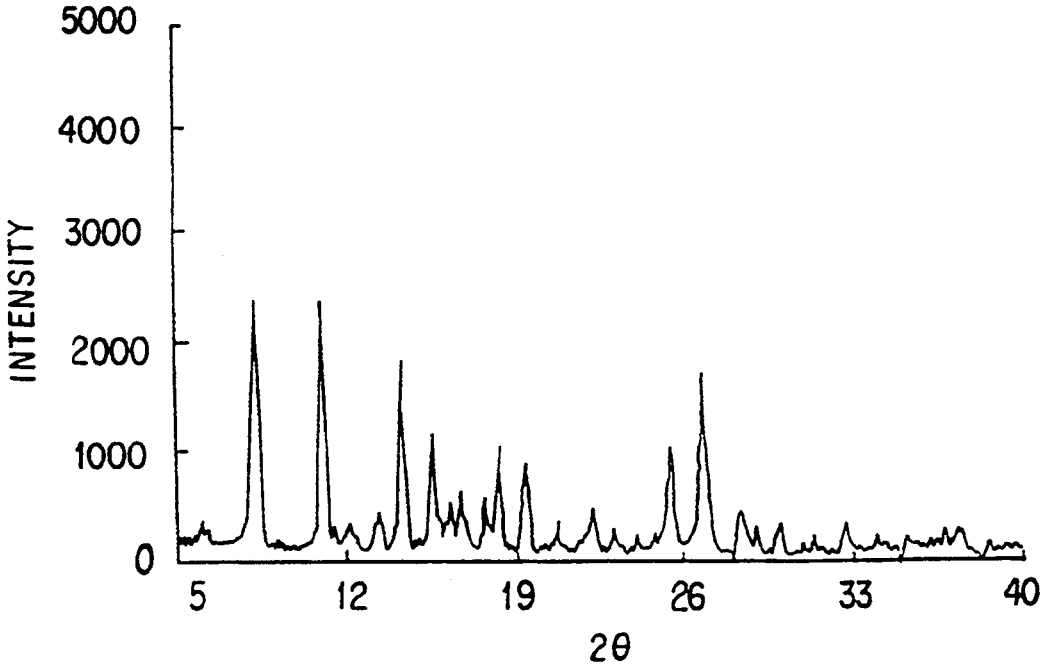
Figure 13:
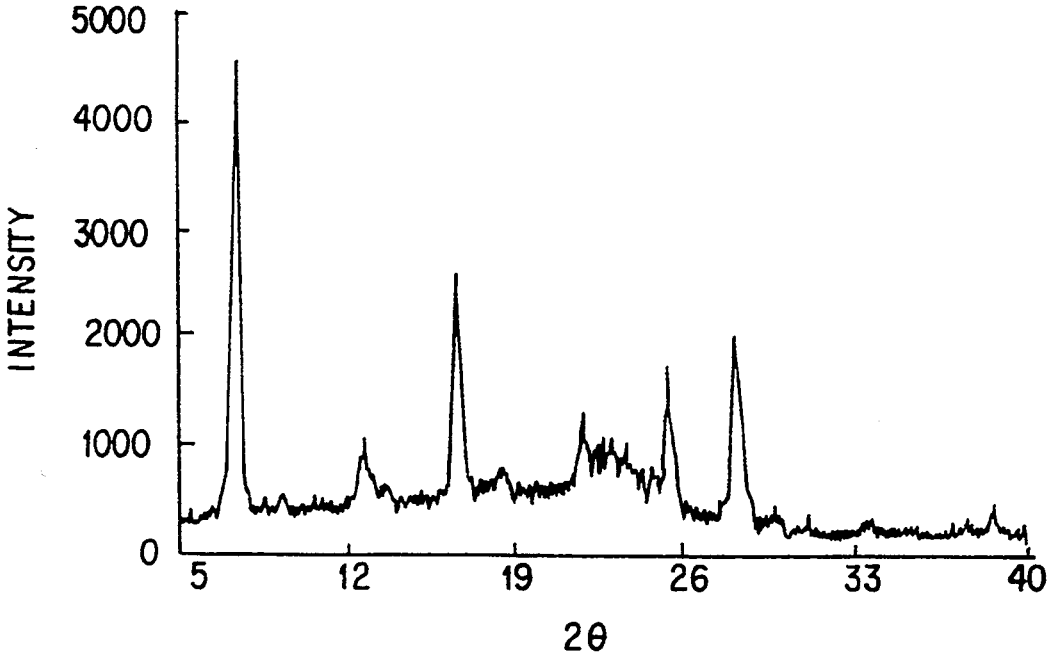
Figure 14:
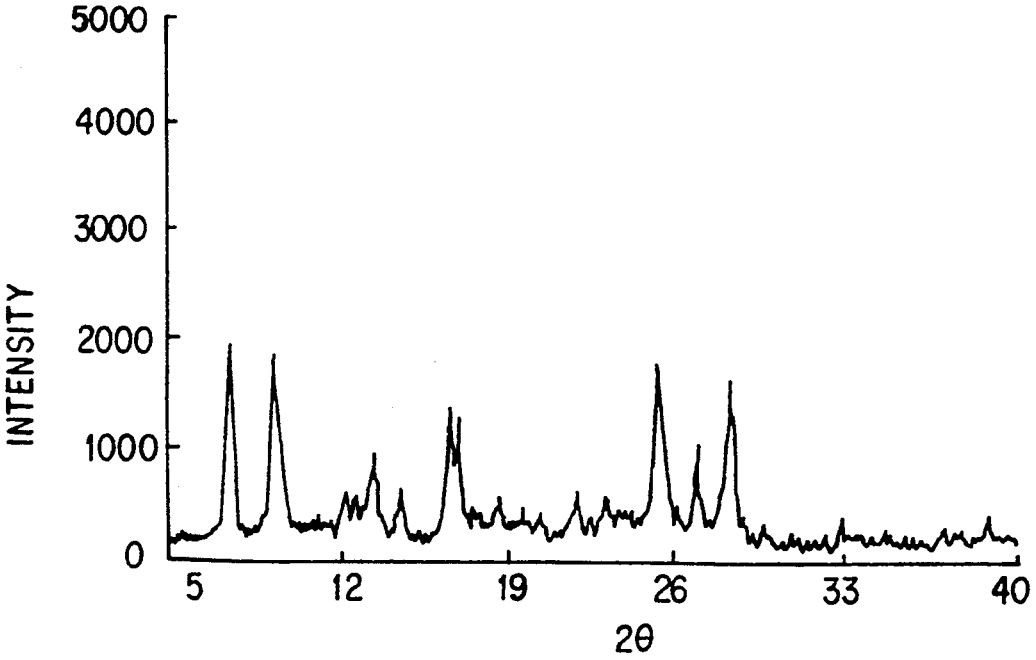
Figure 15:
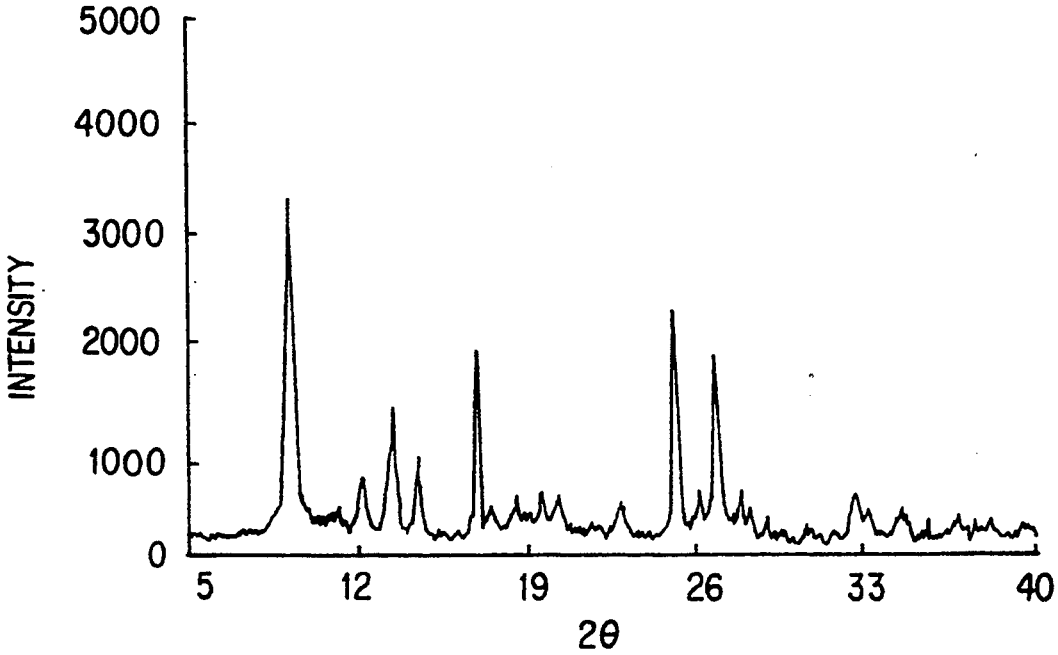
Figure 16:
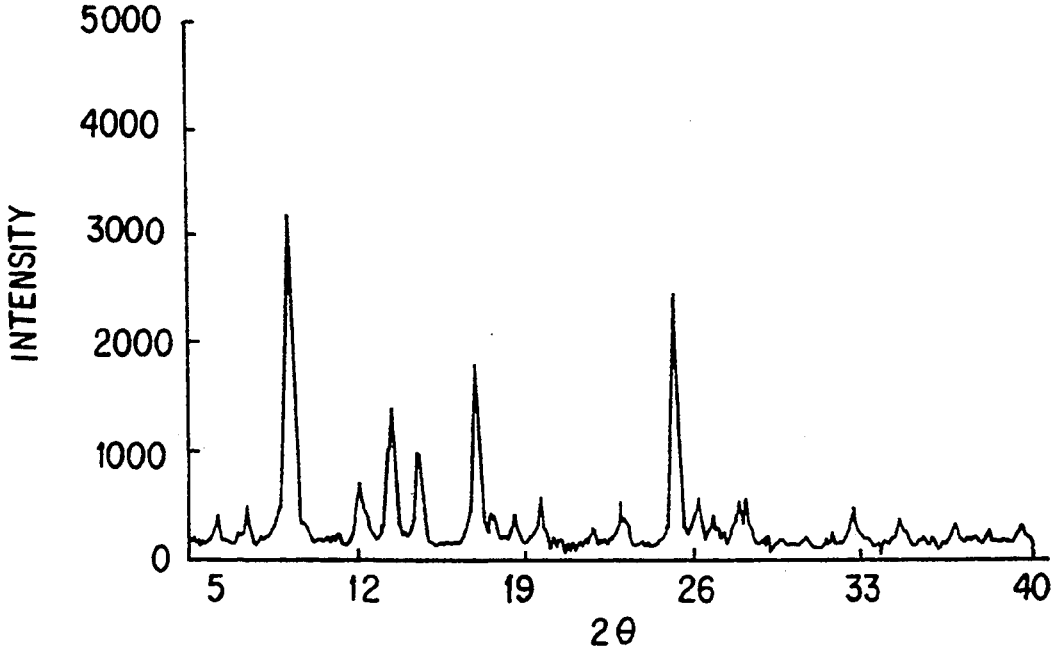
Figure 17:
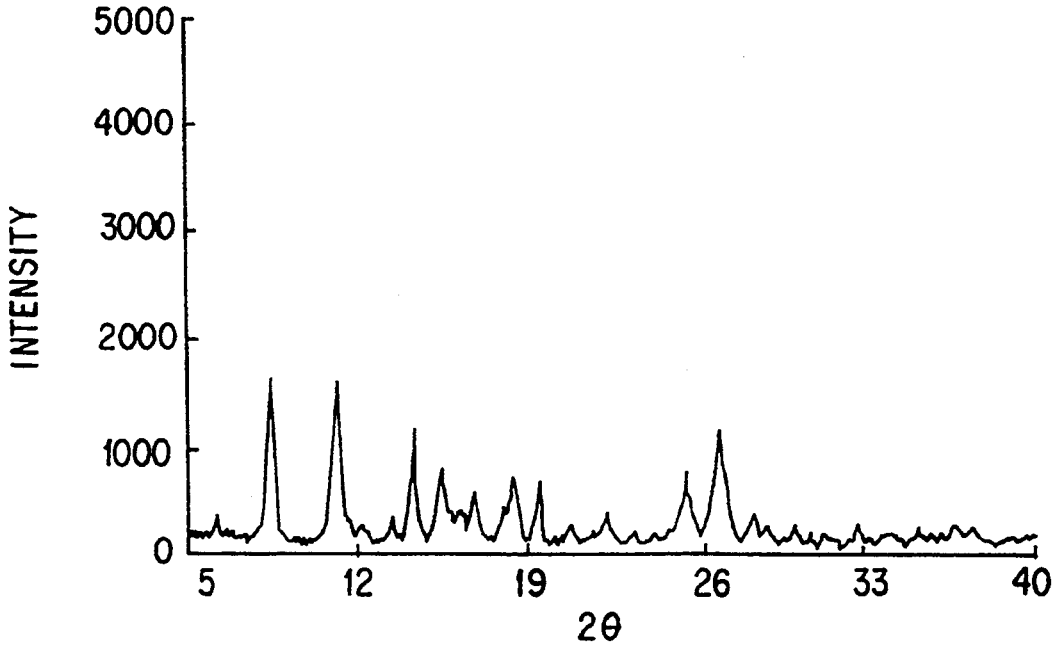
Figure 18:
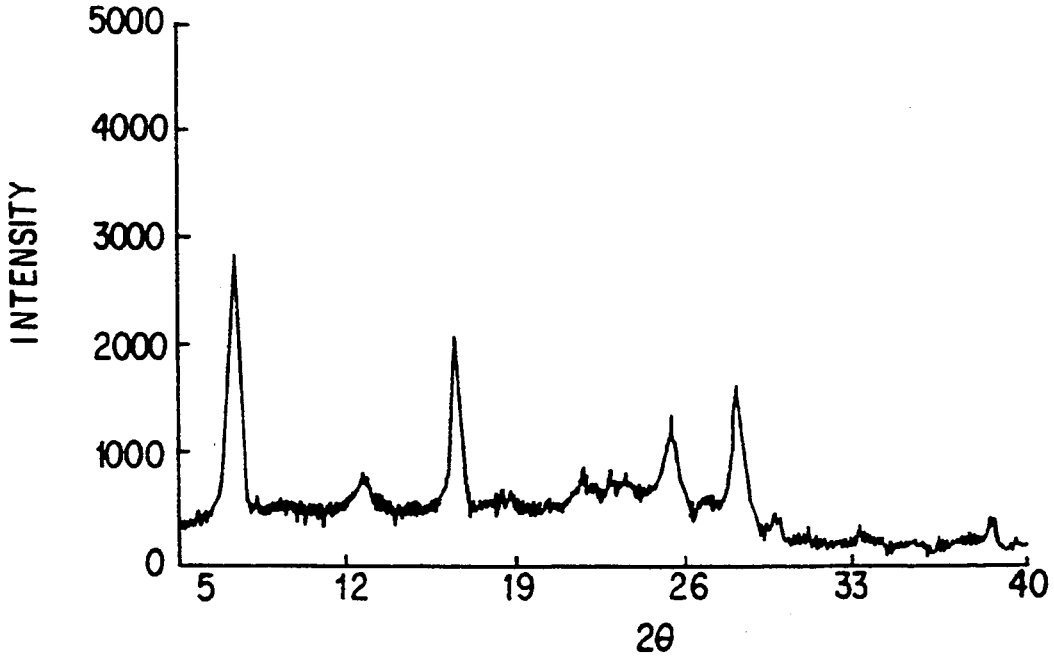
Figure 19:
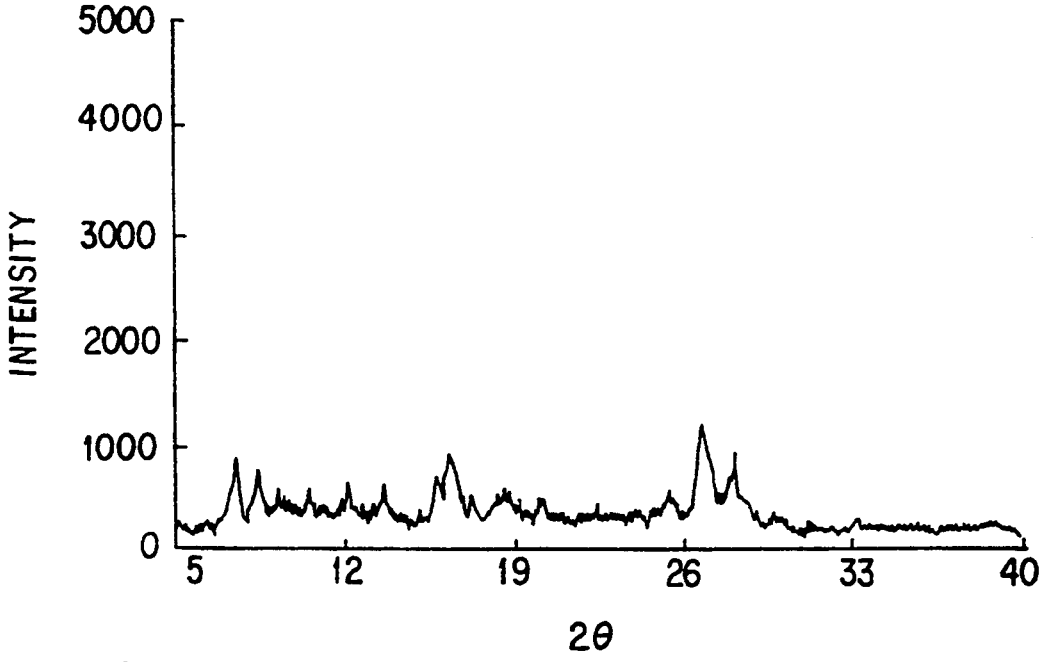
Figure 20:
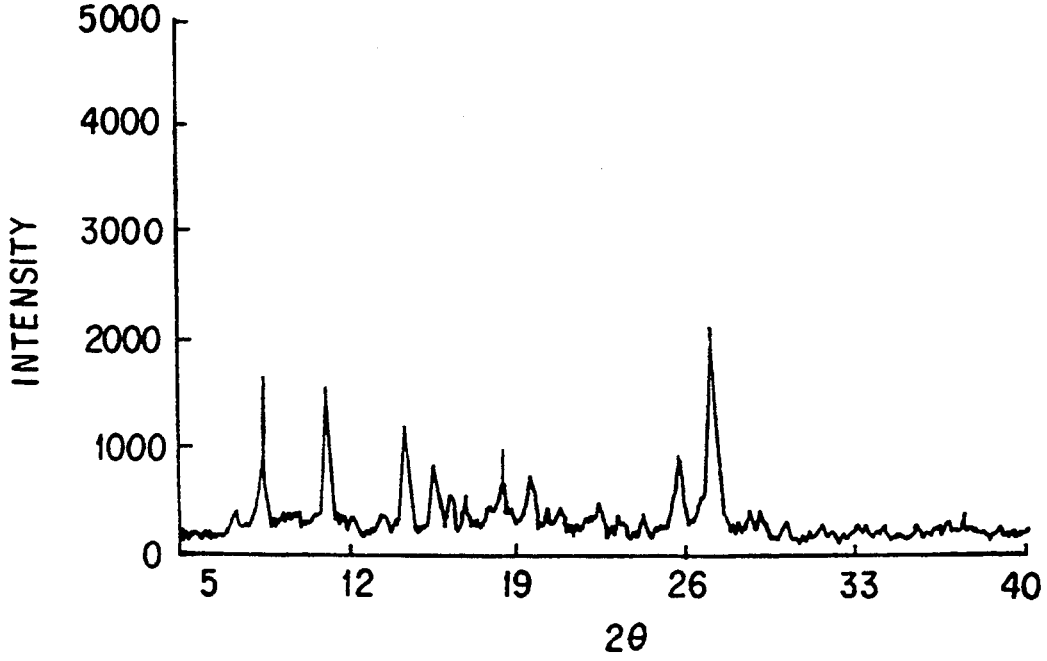
Figure 21:
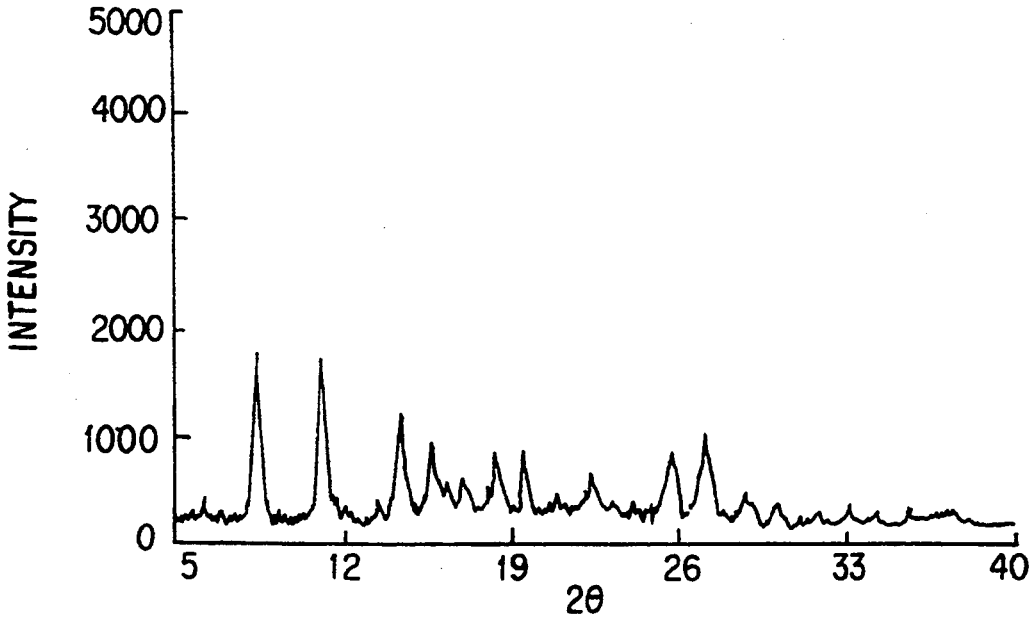
Figure 22:
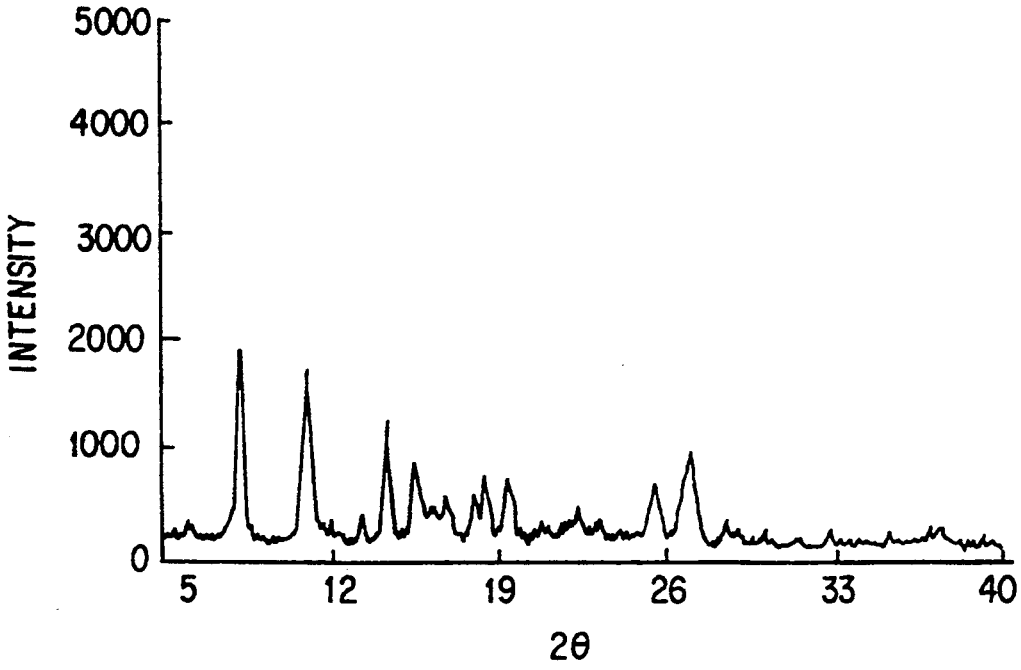

In a 100 ml-volume glass container were put 0.5 g of the mixed crystal obtained in Example 1 and 15 ml of methylene chloride together with 30 g of glass beads (diameter: 1 m/m), and the mixture was subjected to milling at 150 rpm for 24 hours. The crystals were collected by filtration and dried to obtain 0.4 g of a dichlorotin phthalocyanine-chlorogallium phthalocyanine mixed crystal. The powder X-ray diffraction pattern of the resulting mixed crystal is shown in FIG. 8 wherein the intense X-ray diffraction peaks are at Bragg angles ($2\theta \pm 0.2°$) of 6.9°, 17.2°, and 26.9°.

EXAMPLES 7 to 20

The same procedure as in Example 6 was repeated, except for changing the dichlorotin phthalocyanine to chlorogallium phthalocyanine ratio and the kind of the solvent to be used for solvent treatment as shown in Table 1. The powder X-ray diffraction pattern of the resulting mixed crystal is shown in FIGS. 9 to 22.

The intense X-ray diffraction peaks at Bragg angles $2\theta \pm 0.2°$) of the phthalocyanine mixed crystals used in Examples 7 to 20 are shown below.

| Example No. | Bragg Angles ($2\theta \pm 0.2°$) |
|---|---|
| Example 7 | 6.9°, 8.4°, 17.3°, 26.9°, 28.2° |
| Example 8 | 8.4°, 26.9°, 28.2° |
| Example 9 | 8.5°, 11.2°, 14.5°, 25.7°, 27.2° |

-continued

| Example No. | Bragg Angles ($2\theta \pm 0.2°$) |
|---|---|
| Example 10 | 8.5°, 11.2°, 14.5°, 25.7°, 27.2° |
| Example 11 | 7.4°, 16.6°, 25.5°, 28.3° |
| Example 12 | 7.4°, 9.2°, 25.5°, 26.9°, 28.6° |
| Example 13 | 9.2°, 17.0°, 25.2°, 26.9° |
| Example 14 | 9.2°, 17.0°, 25.3° |
| Example 15 | 8.5°, 11.2°, 14.5°, 25.7°, 27.2° |
| Example 16 | 7.4°, 16.6°, 25.5°, 28.3° |
| Example 17 | 7.4°, 8.4°, 16.5°, 26.9° |
| Example 18 | 8.5°, 11.2°, 14.5°, 25.7°, 27.2° |
| Example 19 | 8.5°, 11.2°, 14.5°, 25.7°, 27.2° |
| Example 20 | 8.5°, 11.2°, 14.5°, 25.7°, 27.2° |

COMPARATIVE EXAMPLE 1

Ten grams of the dichlorotin phthalocyanine crystal obtained in Synthesis Example 1 were subjected to grinding in the same manner as in Example 1. The powder X-ray diffraction pattern of the resulting powder is shown in FIG. 23.

COMPARATIVE EXAMPLE 2

Ten grams of the chlorogallium phthalocyanine crystal obtained in Synthesis Example 2 were subjected to grinding in the same manner as in Example 1. The powder X-ray diffraction pattern of the resulting powder is shown in FIG. 24.

COMPARATIVE EXAMPLES 3 to 8

The same procedure as in Example 6 was repeated, except for changing the combination of a crystal to be treated and a solvent as shown in Table 1. The powder X-ray diffraction pattern of the resulting crystal is shown in FIGS. 25 to 30.

TABLE 1

| ClGaPc (wt %)/ $Cl_2SnPc$ (wt %) | 100/0 | 95/5 | 75/25 | 50/50 | 25/75 | 5/95 | 0/100 |
|---|---|---|---|---|---|---|---|
| Crystal Form After Dry Grinding | Compara. Example 2 FIG. 24 | Example 1 FIG. 3 | Example 2 FIG. 4 | Example 3 FIG. 5 | Example 4 FIG. 6 | Example 5 FIG. 7 | Compara. Example 1 FIG. 23 |
| Crystal Form After Solvent Treatment: | | | | | | | |
| $CH_2Cl_2$ Treatment | Compara. Example 6 FIG. 28 | Example 6 FIG. 8 | Example 7 FIG. 9 | Example 8 FIG. 10 | Example 9 FIG. 11 | Example 10 FIG. 12 | Compara. Example 3 FIG. 25 |
| THF Treatment | Compara. Example 7 FIG. 29 | Example 11 FIG. 13 | Example 12 FIG. 14 | Example 13 FIG. 15 | Example 14 FIG. 16 | Example 15 FIG. 17 | Compara. Example 4 FIG. 26 |
| Benzyl alcohol Treatment | Compara. Example 8 FIG. 30 | Example 16 FIG. 18 | Example 17 FIG. 19 | Example 18 FIG. 20 | Example 19 FIG. 21 | Example 20 FIG. 22 | Compara. Example 5 FIG. 27 |

EXAMPLE 21

A coating composition comprising 10 parts of an organozirconium compound ("Orgatics ZC540" produced by Matsumoto Seiyaku K.K.), 2 parts of a silane coupling agent ("A1110" produced by Nippon Unicar Co., Ltd.), 30 parts of isopropyl alcohol, and 30 parts of n-butanol was coated on an aluminum-plated substrate by dip coating and dried at 150° C. for 5 minutes to form a 0.1 μm thick subbing layer.

A mixture of 0.1 part of the dichlorotin phthalocyanine-chlorogallium phthalocyanine mixed crystal obtained in Example 6, 0.1 part of polyvinyl butyral ("S-Lec BM-S" produced by Sekisui Chemical Co., Ltd.), and 10 parts of cyclohexanone was dispersed in a paint shaker together with glass beads for 1 hour to prepare a coating composition. The resulting coating composition was coated on the subbing layer by dip coating and dried at 100° C. for 5 minutes to form a 0.2 μm thick charge generating layer.

In 8 parts of monochlorobenzene were dissolved 1 part of a compound of formula (1) shown below and 1 part of poly(4,4-cyclohexylidenediphenylene carbonate) of formula (2) shown below, and the resulting coating composition was coated on the charge generating layer by dip coating and dried at 120° C. for 1 hour to form a 20 μm thick charge transporting layer.

(1)

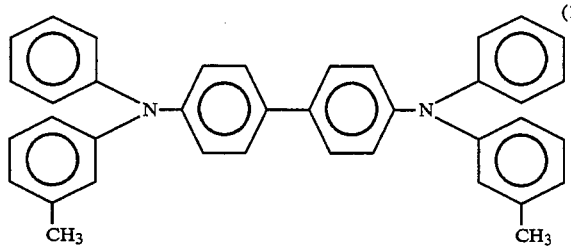

(2)

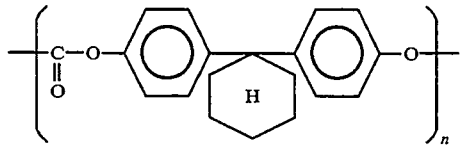

Electrophotographic characteristics of the resulting electrophotographic photoreceptor were evaluated by making the following measurements with a device for evaluating electrophotographic characteristics under a normal temperature and normal humidity condition (20° C., 40% RH). The results obtained are shown in Table 2 below.

1) Initial Surface Potential ($V_{DDP}$):

The photoreceptor was charged to −6.0 kV by a corona discharge, and the surface potential after 1 second ($V_{DDP}$) was measured.

2) Light Decay Rate ($E_{\frac{1}{2}}$):

The charged photoreceptor was exposed to monochromatic light (800 nm) isolated from light emitted from a tungsten lamp by a monochrometer at an energy density of 1 μW/cm². The exposure amount $E_{\frac{1}{2}}$ (erg/cm²) necessary for the surface potential being reduced to a half value of $V_{DDP}$ was measured.

3) Residual Potential ($V_{RP}$):

The photoreceptor was exposed to white light of 50 erg/cm² for 0.5 second, and the residual surface potential ($V_{RP}$) was measured.

4) Durability:

The above-described charging and exposure were repeated 1000 times, and $V_{DDP}$ and $V_{RP}$ were measured to obtain a difference from those in the initial stage ($\Delta V_{DDP}$, $\Delta V_{RP}$).

EXAMPLES 22 to 29

An electrophotographic photoreceptor was produced in the same manner as in Example 21, except for using the dichlorotin phthalocyanine-chlorogallium phthalocyanine mixed crystal shown in Table 2. The resulting photoreceptor was evaluated in the same manner as in Example 21, and the results obtained are shown in Table 2.

COMPARATIVE EXAMPLES 9 to 14

An electrophotographic photoreceptor was produced in the same manner as in Example 21, except for using the phthalocyanine crystal shown in Table 2. The resulting photoreceptor was evaluated in the same manner as in Example 21, and the results obtained are shown in Table 2.

TABLE 2

| Example No. | Charge Generating Material | Initial Electrophotographic Characteristics $V_{DDP}$ (V) | $E_{\frac{1}{2}}$ (erg/cm$^2$) | $V_{RP}$ (V) | Durability $\Delta V_{DDP}$ (V) | $\Delta V_{RP}$ (V) |
|---|---|---|---|---|---|---|
| Example 21 | Example 6 | −820 | 1.6 | 1.9 | 5 | 0.3 |
| Example 22 | Example 7 | −810 | 1.9 | 3 | 10 | 0.5 |
| Example 23 | Example 8 | −750 | 2.5 | 5 | 15 | 2 |
| Example 24 | Example 9 | −810 | 1.9 | 5 | 10 | 2 |
| Example 25 | Example 10 | −820 | 1.7 | 7 | 10 | 4 |
| Example 26 | Example 11 | −820 | 1.7 | 8 | 9 | 4 |
| Example 27 | Example 15 | −820 | 1.9 | 8 | 11 | 5 |
| Example 28 | Example 16 | −810 | 1.8 | 6 | 8 | 4 |
| Example 29 | Example 20 | −825 | 1.7 | 5 | 9 | 3 |
| Compara. Example 9 | Compara. Example 3 | −840 | 4.0 | 10 | 25 | 7 |
| Compara. Example 10 | Compara. Example 4 | −850 | 3.5 | 8 | 20 | 5 |
| Compara. Example 11 | Compara. Example 5 | −845 | 4.0 | 11 | 28 | 8 |
| Compara. Example 12 | Compara. Example 6 | −840 | 2.8 | 2.3 | 10 | 0.5 |
| Compara. Example 13 | Compara. Example 7 | −820 | 2.4 | 2.1 | 10 | 0.8 |
| Compara. Example 14 | Compara. Example 8 | −820 | 1.9 | 2 | 35 | 0.1 |

The phthalocyanine mixed crystal according to the present invention, comprising a dihalogenotin phthalocyanine and a halogenogallium phthalocyanine, has a novel crystal form with high stability and serves as an excellent charge generating material to provide a highly reliable electrophotographic photoreceptor having high sensitivity, excellent stability on repeated use, and excellent environmental stability.

While the invention has been described in detail and with reference to specific examples thereof, it will be apparent to one skilled in the art that various changes and modifications can be made therein without departing from the spirit and scope thereof.

What is claimed is:

1. A phthalocyanine mixed crystal comprising a dihalogentin phthalocyanine and a halogenogallium phthalocyanine, wherein said mixed crystal has an intense X-ray diffraction peak at a Bragg angle ($2\theta \pm 0.2°$) of 26.9°.

2. A phthalocyanine mixed crystal as claimed in claim 1, wherein said dihalogenotin phthalocyanine is dichlorotin phthalocyanine.

3. A phthalocyanine mixed crystal as claimed in claim 1, wherein said halogenogallium phthalocyanine is chlorogallium phthalocyanine.

4. An electrophotographic photoreceptor comprising a conductive substrate having provided thereon a photosensitive layer containing a phthalocyanine mixed crystal comprising a dihalogentin phthalocyanine and a halogenogallium phthalocyanine, wherein said mixed crystal has an intense X-ray diffraction peak at a Bragg angle ($2\theta \pm 0.2°$) of 26.9°.

5. An electrophotographic photoreceptor as claimed in claim 4, wherein said dihalogenotin phthalocyanine is dichlorotin phthalocyanine.

6. An electrophotographic photoreceptor as claimed in claim 4, wherein said halogenogallium phthalocyanine is chlorogallium phthalocyanine.

7. A phthalocyanine mixed crystal as claimed in claim 1, wherein said dihalogentin phthalocyanine has the formula:

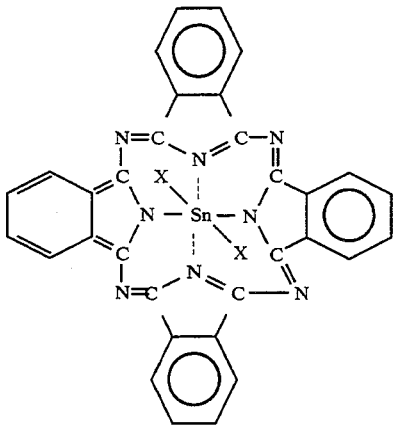

wherein X represents a fluorine atom, a chlorine atom, a bromine atom, or an iodine atom.

8. A phthalocyanine mixed crystal as claimed in claim 1, wherein said halogenogallium phthalocyanine has the formula:

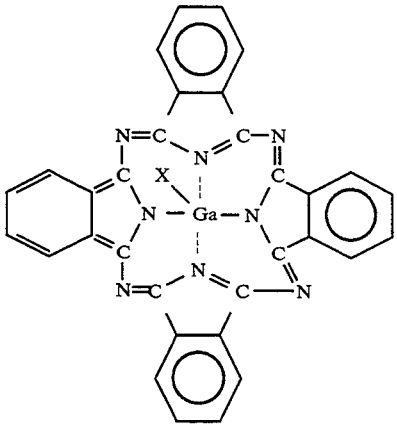

wherein X represents a fluorine atom, a chlorine atom, a bromine atom, or an iodine atom.

9. An electrophotographic photoreceptor as claimed in claim 4, wherein said dihalogentin phthalocyanine has the formula:

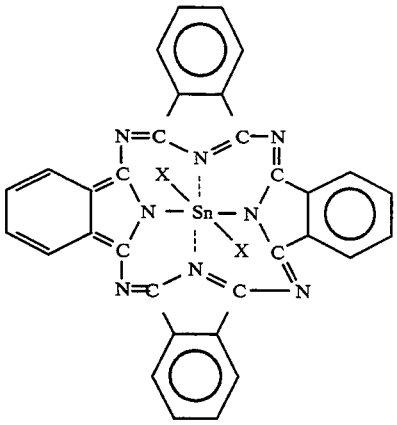

wherein X represents a fluorine atom, a chlorine atom, a bromine atom, or an iodine atom.

10. An electrophotographic photoreceptor as claimed in claim 4, wherein said halogenogallium phthalocyanine has the formula:

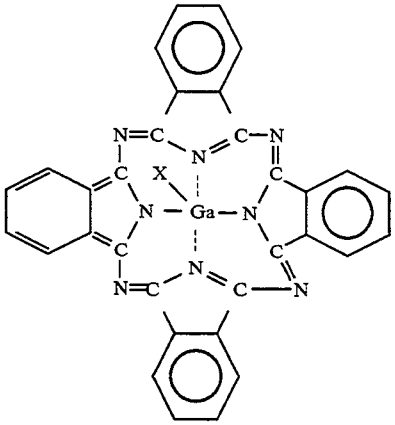

wherein X represents a fluorine atom, a chlorine atom, a bromine atom, or an iodine atom.

11. A phthalocyanine mixed crystal consisting essentially of a dihalogentin phthalocyanine and a halogenogallium phthalocyanine.

12. An electrophotographic photoreceptor comprising a conductive substrate having provided thereon a photosensitive layer consisting essentially of a phthalocyanine mixed crystal consisting essentially of a dihalogentin phthalocyanine and a halogenogallium phthalocyanine.

* * * * *

UNITED STATES PATENT AND TRADEMARK OFFICE

CERTIFICATE OF CORRECTION

PATENT NO. : 5,336,578
DATED : August 9, 1994
INVENTOR(S) : Katsumi Nukada, et. al.

It is certified that error appears in the above-indentified patent and that said Letters Patent is hereby corrected as shown below:

Title page, item [75], Assignee: should be --Katsumi Daimon--.

Signed and Sealed this

First Day of November, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,336,578

DATED : August 9, 1994

INVENTOR(S) : Katsumi Nukada, et al.

It is certified that error appears in the above-indentified patent and that said Letters Patent is hereby corrected as shown below:

Title Page, item [75] Inventors: "Katsumi Damion" should be --Katsumi Daimon--.

This certificate supersedes Certificate of Correction issued November 1, 1994.

Signed and Sealed this

Fourteenth Day of February, 1995

*Attest:*

*Attesting Officer*

BRUCE LEHMAN

*Commissioner of Patents and Trademarks*